United States Patent [19]

Keritsis et al.

[11] Patent Number: 4,989,620

[45] Date of Patent: Feb. 5, 1991

[54] METHOD AND APPARATUS FOR COATING EXTRUDED TOBACCO-CONTAINING MATERIAL

[75] Inventors: Gus D. Keritsis; Richard A. Thesing; Walter A. Nichols, all of Richmond, Va.

[73] Assignee: Philip Morris Incorporated, New York, N.Y.

[21] Appl. No.: 246,089

[22] Filed: Sep. 19, 1988

Related U.S. Application Data

[63] Continuation-in-part of Ser. No. 74,990, Jul. 17, 1987, Pat. No. 4,874,000, which is a continuation-in-part of Ser. No. 900,715, Aug. 27, 1986, abandoned, which is a continuation-in-part of Ser. No. 740,325, Jun. 3, 1985, Pat. No. 4,632,131, and a continuation-in-part of Ser. No. 627,407, Jul. 3, 1984, abandoned, and a continuation-in-part of Ser. No. 723,883, Apr. 16, 1985, Pat. No. 4,625,737, and a continuation-in-part of Ser. No. 457,505, Dec. 30, 1982, Pat. No. 4,510,950.

[51] Int. Cl.[5] ..... A24B 3/14

[52] U.S. Cl. ..... 131/371; 131/375; 131/354; 131/364

[58] Field of Search ..... 131/375, 354, 371, 364, 131/369

[56] References Cited

U.S. PATENT DOCUMENTS

| | | | |
|---|---|---|---|
| 2,734,509 | 2/1956 | Jurgensen, Jr. . | |
| 3,085,580 | 4/1963 | Muth | 131/371 |
| 3,396,734 | 8/1968 | Jansson | 131/375 |
| 3,398,754 | 8/1968 | Tughan . | |
| 3,951,155 | 4/1976 | Prouse et al. . | |
| 4,286,605 | 11/1981 | Goslin et al. . | |
| 4,534,371 | 6/1985 | White . | |
| 4,534,372 | 7/1985 | White . | |
| 4,542,755 | 9/1985 | Selke et al. . | |
| 4,640,219 | 2/1987 | Anderson et al. . | |
| 4,797,318 | 1/1989 | Brooker et al. . | |

FOREIGN PATENT DOCUMENTS

| | | |
|---|---|---|
| 545180 | 5/1956 | Belgium . |
| 1092795 | 9/1981 | Canada . |
| 069467 | 12/1983 | European Pat. Off. . |
| 162476 | 11/1985 | European Pat. Off. . |
| 248128 | 12/1987 | European Pat. Off. . |
| 1487068 | 5/1967 | France . |

*Primary Examiner*—V. Millin

*Attorney, Agent, or Firm*—Robert M. Isackson

[57] ABSTRACT

An apparatus and a method for processing extruded tobacco-containing materials as they are continuously extruded by applying a powdery material to the surface of the extrudate, optionally wiping the coated extruded material in order to smear or embed the powdery materials along and into the surface of the extruded material. The powdery material may be a flavorant or other additive materials modifying the characteristics of the extruded material. The invention is useful particularly for use in processing foamed, extruded materials into smoking articles which can be used with conventional cigarette maker equipment to produce large quantities of foamed, extruded tobacco-containing smoking articles having properties substantially equivalent to those of a conventional cigarette.

19 Claims, 1 Drawing Sheet

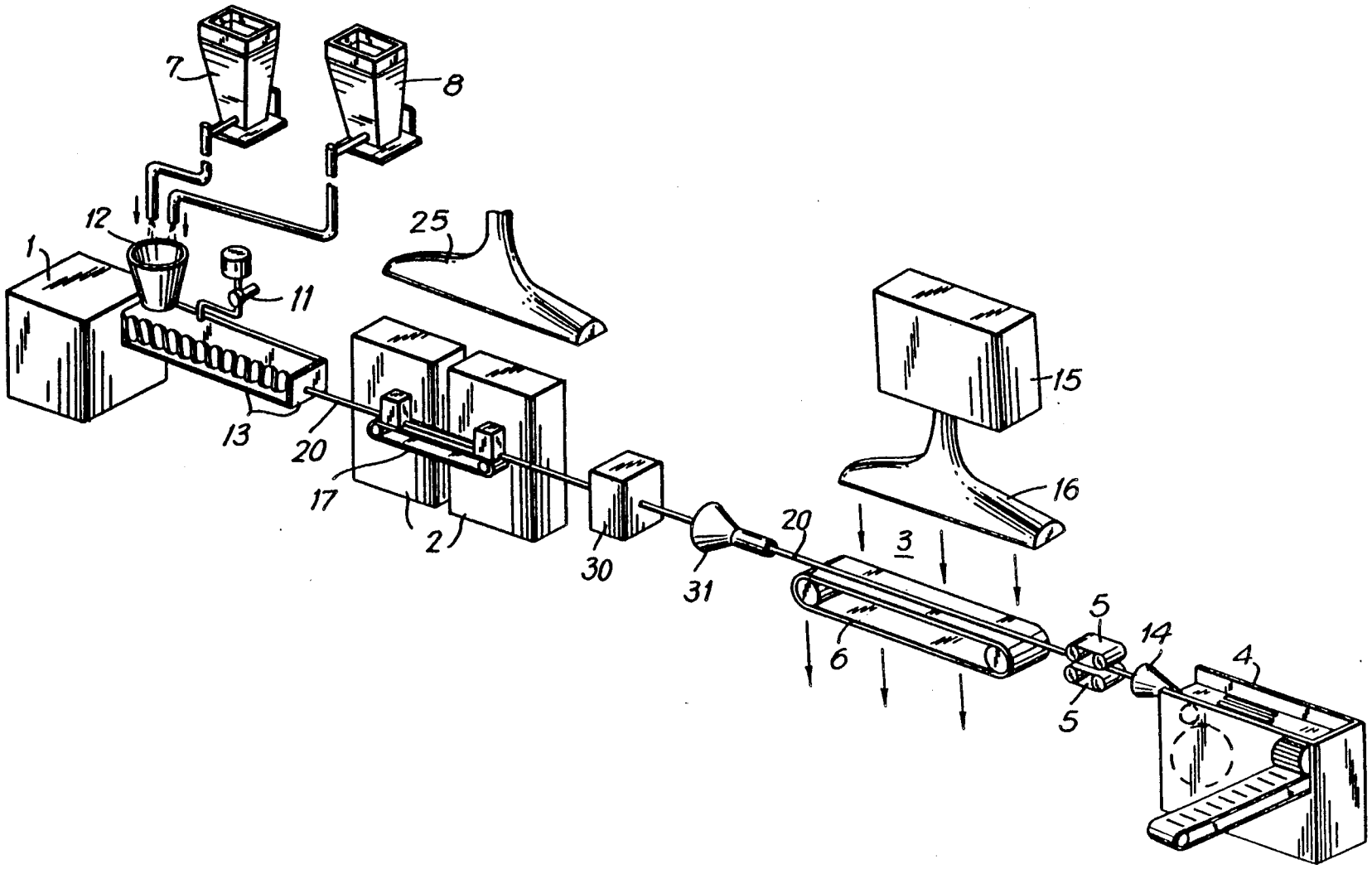
1
2
3
4
5
5
6
7
8
11
12
13
14
15
16
17
20
20
25
30
31

METHOD AND APPARATUS FOR COATING EXTRUDED TOBACCO-CONTAINING MATERIAL

CROSS REFERENCE TO RELATED APPLICATIONS

This application is a continuation-in-part of application Ser. No. 074,990, now U.S. Pat. No. 4,874,000, filed July 17, 1987, by Ronald A. Tamol, Gus D. Keritsis, Richard A. Thesing, Jose G. Nepomuceno, George H. Burnett, Warren D. Winterson, and Walter A. Nichols entitled Method And Apparatus For Drying And Cooling Extruded Tobacco-Containing Material, which is a continuation-in-part of application Ser. No. 900,715 filed Aug. 27, 1986, now abandoned, by Ronald A. Tamol, Gus D. Keritsis, Richard A. Thesing, Jose G. Nepomuceno, George H. Burnett, Warren D. Winterson, and Walter A. Nichols entitled Method And Apparatus For Drying And Cooling Extruded TobaccoContaining Material, which is a continuation-in-part of: application Ser. No. 740,325 filed June 3, 1985 now U.S. Pat. No. 4,632,131 by George H. Burnett, Richard A. Thesing, Gus D. Keritsis, Jose G. Nepomuceno, Alline R. Wayte, and Alex S. Gergely entitled Foamed, Extruded, Coherent Multistrand Smoking Article, which is a continuation-in-part application of application Ser. No. 627,407 filed July 3, 1984, now abandoned by George H. Burnett, Gus D. Keritsis, Alline R. Wayte, and Jose G. Nepomuceno entitled Foamed. Extruded, Coherent Multistrand Smoking Articles, now abandoned, and this application is a continuation-in-part application of application Ser. No. 723,883 filed Apr. 16, 1985 by Gus D. Keritsis, George H. Burnett, Richard A. Thesing and Walter A. Nichols entitled Foamed, Extruded Tobacco-Containing Smoking Article, which issued as U.S. Pat. No. 4,625,737 and is a continuation of application Ser. No. 457,505 filed Dec. 30, 1982 by Gus D. Keritsis and Walter A. Nichols entitled Foamed, Extruded, Tobacco-Containing Smoking Article And Method of Making The Same, which issued as U.S. Pat. No. 4,510,950.

BACKGROUND

Manufactured tobacco and smoking articles are well-known. See, e.g., U.S. Pat. Nos. 235,885; 235,886; 2,433,877; 2,445,338; 2,485,670; 2,592,553; 2,598,680; 2,845,933; 3,012,562; 3,085,580; 3,098,492; 3,141,462; 3,203,432; 3,209,763; 3,223,090; 3,298,062; 3,313,003; 3,353,541; 3,364,935; 3,373,751; 3,404,690; 3,404,691; 3,410,279; 3,467,109; 3,528,434; 3,529,602; 3,760,815; 3,894,544; 3,931,824; 3,932,081; 4,083,371; 4,233,993; 4,333,484; 4,340,072; 4,347,855; 4,391,285; Reissue Patent No. 24,424; U.S. Defensive Publication No. T912,011; German Publication Nos. 1,167,717, 1,532,104, 1,782,854, 2,358,657, 2,410,168, and 2,633,627; Canadian Patent No. 951,209; U.K. Publication Nos. 282,369 and 2,064,296; Swiss Patent No. 275,420 Belgian Publication No. 828503 South African Publication No. 69/838; Netherlands Publication No. 143,799; and commonly assigned U.S. Pat. No. 4,510,950, issued Apr. 16, 1985. Some of those documents refer to casting or extrusion of sheets, strands or filaments of tobacco-containing materials or to extrusion of tobacco rods containing axially directed air channels. Some of the products are expanded, foamed, or both.

One approach to making a foamed, extruded smoking article is disclosed in commonly assigned U.S. Pat. Nos. 4,510,950 and 4,625,737 and 4,632,131 the disclosures of which are incorporated by reference in their entirety. The smoking article is typically substantially cylindrical and is extruded under conditions such that the water in the wet blend fed to the extruder die is converted to steam, thereby foaming the article. The article is monolithic, that is, it is extruded as a single strand with a diameter of from about 2 to about 35 mm, preferably from about 4 to about 25 mm, typically about 4 to 8 mm if the article is a cigarette.

Another approach is to extrude the wet blend out a die having a plurality of small apertures to form an extruded, coherent, multistrand, tobacco-containing, generally cylindrical smoking article comprising a plurality of co-extruded strands that extend generally along the longitude of the smoking article and are adhered to one another, preferably randomly, so as to leave flow passageways between the strands along the longitude of the smoking article. This approach is disclosed in commonly assigned U.S. Pat. No. 4,632,131. The configuration of the strands and passageways of these foamed articles provide sufficient heat transfer area or sufficient residence time or both for the hot gases drawn towards the proximal end of the smoking article by a smoker to cool and to exit the proximal end at a temperature comfortable for the smoker.

Extruded tobacco materials, particularly the foamed, extruded tobacco materials discussed in U.S. Pat. Nos. 4,625,737 and 4,632,131, are formed from tobacco particles, binder, water, and optionally fillers or other desired additives. They are generally hot, moist, soft, and flexible thermoplastic-like materials as they exit the die. The temperature of extruded materials is typically in the range from 40°–150° C. Working the tobacco-containing material at too high a temperature can result in overworking or cooking of the material, which degrades the quality of the product. Extruding the material at too low a temperature will not foam the material at typical extruder pressures, resulting in too dense a product. The moisture content, measured in terms of oven volatiles or OV, is typically in a range from 15 to 50%, depending on the product formulation and process conditions. This moisture content is above the tobacco equilibrium content of about 10–15%. The terms "moisture content" or OV refers to the solvent in which the tobacco and other materials are mixed before extrusion. Typically, the solvent is water, but organic or alcoholic solvents may be used.

Such continuously formed foamed rod-like extruded materials are too hot, moist, and pliable to be formed directly into smoking articles at high rates of speed by, for example, passing the rods into an automated smoking article "maker" machine such as a Mark 8 Cigarette Maker manufactured by the Molins Company or the like. These materials do not have enough structural integrity to be wrapped and formed into smoking articles without further processing.

The known methods of post extrusion processing of extruded materials include drying the extruded materials to reduce the OV to about the equilibrium OV of tobacco. Drying occurs commonly by allowing the solvent used in the pre-extruded slurry, e.g., water or other agents such as alcohols that aid in evaporation, to evaporate in air at atmospheric or reduced pressures. In some cases suction devices may be used to remove the solvent before drying. In other cases, the extruded materials are dried by infra-red heaters, steam, or hot air, in a conventional drying oven.

The foregoing techniques are inadequate for commercial utilization of continuously extruded materials, particularly foamed extruded materials, because they require long periods of time to reduce the OV to the desired level. These techniques require storage facilities or drying ovens (which can extend hundreds of feet) to dry sufficiently the material, each of which are impractical and costly to maintain in a commercial operation. With very slow rates of drying or low temperature drying, a foamed structure can collapse under its own weight, develop undesirable flat spots against a supporting structure, or otherwise result in a product having a non-uniform density. This adversely affects the burn qualities and consumer acceptance of the smoking article. Attempts to heat rapidly the materials, particularly foamed rods, result in case hardening the outer portions of the extruded material, which in turn inhibits the interior section from drying sufficiently. Case hardening can increase the drying time by an order of magnitude, e.g., from minutes to hours, or hours to days. Overdrying the exterior to dry the interior can result in a brittle product that crumbles when manipulated. Over-drying also can lead to a wrinkled or cracked product or an unduly stiff product, each of which is unacceptable to the consumer.

It also is known to use microwave energy to dry extruded materials somewhat uniformly to reduce the OV to the desired level. However, known microwave drying techniques do not solve adequately the space and time requirements needed to dry continuously advanced foamed, extruded tobacco-containing material into smoking article forming apparatus at high rates of speed in a commercially feasible operation. Moreover, even with known microwave drying, the extruded materials are still too pliable to be formed into the desired smoking article.

Another problem with extruded tobacco-containing materials is that the extrusion processes do not typically provide a smokable material having an appropriate taste or other subjective attributes that are desirable.

It is known that various flavorants and/or humectants that are commonly employed in the manufacture of smoking articles may be added prior to extrusion or may be subsequently added to the extruded material. An example of adding flavorants to a smoking material prior to being fed to a maker apparatus is found in commonly assigned U.S. Pat. No. 4,619,276. However, many conventional flavorants will not survive the extrusion temperatures and pressures. Further, conventional application of flavorants in metered amounts on passing material is not believed to be well-suited for use with the tobacco-containing extrudates of the type described herein.

Among the objects of the present invention are:

to provide an improved method and apparatus for post extrusion processing of an extruded tobacco-containing material;

to provide a method and apparatus for rapidly processing a continuously advancing, tobacco-containing, foamed, extruded rod-like product for use in apparatus for forming smoking articles at high rate of speed;

to provide a method and apparatus for producing foamed, extruded tobacco-containing smoking articles having a substantially uniform density characteristic;

to provide a method and apparatus for producing extruded, tobacco-containing smoking articles having a uniform circumference, length, moisture content; and to provide a method and apparatus for producing extruded tobacco-containing smoking articles where the solubles are substantially inhibited from migrating to the surface of the articles; and to provide a method and apparatus for producing foamed extruded tobacco containing smoking articles having applied thereto a solid and preferably a powdery material for modifying the characteristics of the extruded material.

SUMMARY OF THE INVENTION

The present invention is directed to processing of extruded tobacco-containing material by applying to the surface of the extruded material dry powdery materials less than about 14 mesh in size, preferably less than 40 mesh in size, for modifying the characteristics of the extruded material. The solid or dry powdery materials may include, for example, dry powdery tobacco of a single variety or of a blend having an OV of less than 15%, spices or other flavorings, or inorganic or organometallic salts, e.g., $CaCO_3$, or fillers (e.g., carbon, $Al_2O_3$, $TiO_2$, silicates and the like) or hydrocolloids. A wiper or sizing die may be used to remove excess powdery particles, evenly distribute the particles on the surface of the extrudate, and embed the particles in the surface of the extrudate, thereby reducing particle fallout, the surface porosity of the rod, or both.

Incorporating such a solid or powdery material on the surface of the extruded tobacco-containing rod reduces friction between the advancing rod and the apparatus and makes the rod easier to process. Incorporating flavor materials to the surface of the extruded rod improves the flavor and subjective room aroma of the smoking articles as compared to adding flavorants to the extruder mixing chamber prior to extrusion, and also allows for using a lesser amount of flavoring material more efficiently by carefully controlled application. For example, in one embodiment, a smoking article could be formed from an extruded material having a high resistance to draw and low tar coated with a powdery material, whereby the flavor and desirable subjective attributes of the smoking article are predominately supplied by the powdery coating. This could result in a reduced tar smoking article having all the desired subjective qualities of a conventional higher tar smoking article.

Powdery materials that have a tendency to become film forming with heat, moisture, or both may be used, typically in conjunction with a wiper means located downstream of the coating applicator, to reduce the porosity of the extrudate surface to allow for fabricating smoking articles that do not require wrapping. Such a wiper or sizing die may be heated to facilitate spreading and film forming or dispersions of thermoplastic or meltable coatings. Alternately, when the article is to be wrapped, a powdery material such as $CaCO_3$ or tobacco could be applied to reduce the likelihood of the extrudate staining any paper wrapper applied to the extrudate in making paper wrapped smoking articles.

In the preferred embodiment, the extrudate is passed through a box containing the powdery material while the extrudate is sticky, for example, after the extrudate passes through one of a drying chamber or a cooling chamber or both. The powdery material will adhere to the sticky extrudate without requiring the addition of an adhesive agent such as moisture and without relying on surface adhesion or a wrapper. Typically, the powdery material is agitated, or the box containing the powdery material is vibrated to ensure that the extruded material is continuously contacted by powdery material as it passes through the box and to ensure that the powdery material does not become packed so that it will not contact the rod.

As mentioned, the powdery coating may be applied to extruded tobacco-containing smoking materials that have been dried and cooled rapidly, under conditions that will enable the extruded material to be passed directly from the extruder die to apparatus for forming the smoking material into the desired product. The invention applies to both foamed and unfoamed tobacco-containing extruded material.

In the preferred embodiment, the extruded material is first dried to volatize the water or other solvent present in the extruded material and thereby reduce the moisture content to a level at about or preferably below the equilibrium OV level of the tobacco-containing product. Drying also can initiate or continue a foaming operation, when used, by volatizing, gassifying, or decomposing any agent present used to foam the extruded material. Foaming is a result of the moisture, other foaming agent, or gas within the extrudate changing from a super-heated liquid or compressed gas to a gas at essentially atmospheric pressure either as the extruded material leaves the high-pressure environment behind the die inside the extruder and enters the atmospheric environment just downstream of the die openings, or after extrusion, by passing the material through a drying chamber for heating the material so that it foams. The resulting dried material is a hot and pliable thermoplastic material which may be tacky on contact.

After drying, the material may be immediately cooled to lower the temperature of the extruded material. Two temperature definitions used herein are (1) surface temperature, i.e., the temperature detected at the surface of the extruded material; and (2) bulk temperature, i.e., the average temperature of a selected quantity of the tobacco material mass after equilibration in a calorimeter. Cooling the dried extruded material requires reducing the bulk temperature at least somewhat and the surface temperature substantially to give the extruded material an adequately rigid structure, to substantially minimize the tackiness of the surface, and to fix or set dimensionally the extruded material for subsequent forming by the maker apparatus.

The temperature to which the extruded material must be cooled to obtain an adequately rigid structure is a function of the specific ingredients of the thermoplastic tobacco-containing mass and the rate of cooling, and will generally be between about −196° C. and 85° C. for the surface temperature, and between about 20° C. and 90° C. for the bulk temperature. In general, the more cooling achieved, the firmer and better the resulting product. Limits on cooling are principally equipment limitations, the heat capacity of the cooling medium applied and how good an insulator the extruded material is. The dried and cooled mass will likely continue to change dimensions very slightly as it equilibrates with ambient or other controlled conditions.

Preferably, cooling reduces the bulk temperature to about, and the surface temperature sufficiently below, the glass transition temperature of the material to provide a case hardened periphery that is semi-rigid for easy handling by automatic maker machines. Unlike the prior art methods, such a case hardening does not interfere with drying the interior of the material or the equilibration of the finished smoking product to the desired conditions because the material is about equilibrated (except thermally) before it becomes case hardened.

Further, cooling the material below the volatization temperatures for the flavor generating components also may prevent certain flavors, both natural in tobacco and added, from volatizing during a long cooling down period. This enhances the subjective characteristics of the finished article. With foamed materials, the surface and bulk temperatures are preferably lowered to below the flash point of the particular foaming agent used, thereby halting any foaming action caused by drying or residual heat stored in the extruded material during the drying step.

The cooled, dried, coated material may then be fed directly into apparatus for producing the desired smoking article. In one embodiment, the tobacco-containing material could be extruded as a sheet which is dried, cooled, and out up for use as tobacco filler like conventional tobacco leaf or reconstituted tobacco. Alternately, and preferably, the material could be extruded in a rod-like shape having a cylindrical cross section and passed directly from the cooling apparatus into the garniture of a commercially available maker. Optionally, the material may be wrapped with cigarette or cigar wrapper or coated with a formulation capable of forming an outer sheath using coextrusion or post extrusion techniques, before being fed to the maker.

A primary advantage of the present invention is the ability to process the hot, moist, pliable extruded material into a material that can be formed into a smoking article on a continuous basis.

In one embodiment, the tobacco containing material includes particles of tobacco mixed in a solvent medium such as water to form a slurry which is extruded, and microwave energy is used to dry the extruded material substantially uniformly throughout the material as it passes through an appropriately dimensioned microwave cavity. The cavity dimensions and microwave frequency are preselected to obtain the required depth of penetration for the given cross sectional area and configuration of the material to excite and volatize the solvent medium and thereby dry the extruded material. The energy level propagated into the cavity is selected based on the rate of advance of the extruded material, the exposure time and OV (or amount of solvent medium) in the extruded material as it enters the drying cavity and the desired OV as it exits the cavity. Optionally, vents may be provided in or adjacent to the microwave drying cavity to exhaust the steam or other vaporized materials generated by the drying action. Thus, the extruded material is dried uniformly, with the vapors generated from the interior portions replenishing the moisture vaporized from the surface regions to give the material a substantially uniform density while reducing the overall OV level to the desired level without case hardening or embrittling the extruded material.

In a preferred embodiment, two spaced apart microwave cavities may be used in tandem to dry the material passing therethrough. Using two cavities permits venting the vapors between the cavities as well as the input and outputs to the drying section, and permits more precise control over the energy level applied to dry the material. Further, the spacing between the cavities can be adjusted to permit the material to equilibrate somewhat between microwave exposures. Also, the orientation of the microwave cavities can be selected, for example, to be oriented in parallel, or with one cavity rotated about the axis of the extruded material relative to the other cavity to better average the microwave energy and modal power distribution within the extruded material. Thus, using two or more microwave cavities permits drying the material more evenly with somewhat greater control than would be possible with a single microwave drying chamber.

Following the drying step, the extruded material is cooled. In one embodiment, the extruded material is passed through a cooling cavity flushed with refrigerated air, preferably exchanged continuously. Ambient air also may be included in the airflow. Refrigerated air, when used, may be generated by, for example, a conventional air conditioning system, passing ambient air over cooling coils chilled to about 4° C., dry ice, or the like. The temperature of the refrigerated air is selected in view of the rate of speed of the extruded material and total exposure time in the cooling chamber to reduce the surface and bulk temperatures of the extruded material sufficiently to fix dimensionally the material for subsequent handling. Thus, the material must be cooled to be adequately rigid for feeding directly to a wrapper and maker apparatus to make smoking articles.

The extruded material may be advanced through the cooling chamber by means that will permit cooling of the extruded material, preferably by a perforated supporting belt or opposing belts permitting continuously exchanged refrigerated (and optionally ambient) air to contact the hot extruded material. Alternately, an air cushion could be used to support the extruded material as it passes through the cooling chamber. Other conventional conveyance means also could be used.

In another embodiment, the cooling step could be conducted by passing the extruded material through a tunnel having a plurality of air jets so that air exiting the jets at high velocity impinges on the surface of the extruded material. The high velocity air passing through the nozzle of the air jets cools to provide cold air impinging on the extruded material. The air input to the plurality of air jet optionally may be refrigerated in order to further increase the cooling capacity of the tunnel by providing high velocity impinging air at temperatures as low as −28° C.

In another embodiment, the cooling step could be conducted by contacting the hot extruded material with a cooled member, such as one or more cooled rollers, a continuously advanced cooled belt, or cooled particulates. In yet another embodiment, cooling could be achieved by contacting or spraying the hot extruded material with a liquid, such as water or alcohol, nitrogen, or a solid, such as dry ice particles, that will vaporize on contact (substantially without being absorbed) and thereby cool the material. In yet another embodiment, cooling could be achieved by passing the material through a cryogenic chamber that contains, for example, liquid nitrogen. In any case, the contacting temperature or quantity of cooling material applied is selected in view of the overall residence time to provide the desired uniform cooling. Any of the foregoing methods could be used singly or in combination, as necessary to cool rapidly the exterior surface temperature of the extruded material to provide a structure that is sufficiently stiff to pass the product through a cigarette type maker device. Further, the cooling chamber could be at least partially evacuated to aid in cooling.

DETAILED DESCRIPTION OF THE DRAWING

The FIGURE is a schematic view of an embodiment of the tobacco processing apparatus of this invention.

DETAILED DESCRIPTION OF THE INVENTION

Referring to the FIGURE an illustrative embodiment of the tobacco processing apparatus of the present invention is shown. The apparatus of an embodiment of the present invention includes drying cavity 2, and cooling chamber 3, placed in tandem, downstream of extruder 1 and the output of extruder barrel 13, and upstream from smoking article forming device 4, and box 30 containing a dry powdery material to be applied to an extruded tobacco-containing material.

Finely divided tobacco materials are input to input port 12 of extruder 1 at a controlled rate, from supply 7. Binder materials also are input to input port 12 of extruder 1 at a controlled rate. Water, from water supply 11, is input to extruder barrel 13 as necessary to maintain the desired moisture content in the mixing chamber. In other embodiments, the materials are mixed in a different order and fed to different input ports as discussed elsewhere herein in connection with prehydration mixing techniques. A means for advancing extruded material 20 through drying cavity 2, cooling chamber 3 and box 30 is provided. The advancing means is preferably adjusted to advance extruded material 20 at the selected rate of extrusion with substantially no relative movement between extruded material 20 and the contacting or supporting member of the advancing means. Alternately there may be some relative movement where constant tension on or compression of the extruded material is desirable.

The advancing means may comprise one or more conveyor belts operating at the same linear speed. The conveyor may be a supporting belt, a single belt that is folded about to envelope the extruded material, or opposing belts configured to retain and advance the material. Following the cooling section, puller means 5 may be used to feed and advance the leading edge of extruded material 20 into extruded material receiving funnel 14 attached to the input of conventional smoking article maker device 4. Puller 5 may be disengaged once the extruded material is advancing directly into maker device 4.

In the embodiment shown in the FIGURE, following drying means 2 is box 30 containing a dry powdery material to be applied to an extrudate passing through box 30, and wiper 31 for removing excess powdery material and spreading and embedding the powdery material along and in the extrudate surface. Box 30 contains an agitating means (not shown) that keeps the powdery material loose and flowing for example, by agitating the powdery material inside the box, preferably by vibrating the entire box. In an alternate embodiment (not shown) box 30 and wiper 31 maybe located downstream of cooling means 3.

Extruded tobacco-containing material that is hot, wet and pliable may be dried in drying means 2 to about or below the ambient or other controlled level of moisture for the tobacco-containing material, and the dried extruded material may be cooled in cooling means 3 to lower the surface temperature of the extruded material below the bulk temperature to form the tobacco containing material into an adequately rigid material that can be wrapped and severed cleanly into smoking articles. The surface temperature is typically lowered to between about −196° C. and 85° C. and the bulk temperature lowered to between about 20° C. and 90° C. Cooling provides the surface that extends about the periphery of the extruded material with a case hardened semi-rigid structure so that it can be thereafter severed and formed into smoking articles by maker device 4.

In one embodiment, the tobacco-containing extrudate may be formed by mixing together finely divided tobacco materials, binder materials, water (or other solvent) and other desired additives in extruder 1 to create a thoroughly mixed slurry, extruding the slurry out the die at the end of the mixing chamber or barrel 13 of extruder 1 to form a cohesive extruded material, preferably having a rod-like configuration, drying the extruded material in drying cavity 2, cooling the extruded material in cooling chamber 3, coating the extruded material with a powdery material, and advancing the extruded material into maker device 4 for forming the desired smoking articles of, for example, substantially uniform dimensions.

In the preferred embodiment, the present invention is adaptable for use in forming foamed extruded smoking articles comprising (a) from about 5 to about 98 wt. % of tobacco particles having a particle size of up to about 5 mesh, (b) from 0 to about 60 wt. % of a filler having a particle size of up to about 350 μm, (c) from 0 to about 1.0 wt. % of a residual foaming agent, (d) from about 2 to about 40 wt. % of a binder selected from the groups of (1) cellulosic binders consisting of hydroxypropyl cellulose, carboxymethyl cellulose and its sodium, potassium, and ammonium salts, cross-linked carboxymethyl cellulose and its sodium, potassium, and ammonium salts, hydroxyethyl cellulose, ethyl hydroxyethyl cellulose, hydroxypropyl methyl cellulose, methyl cellulose, ethyl cellulose, and mixtures thereof: or (2) natural binders, modified natural binders, and synthetic binders consisting of pectin and its ammonium, sodium, and potassium salts, starch, guar, locust bean gum, chitin, chitosan, and derivatives thereof, hemicellulose, xanthan, curdlan, a salt of xanthamonas gum, carageenan, alginic acid and its ammonium, sodium, and potassium salts, chitosan and its water soluble salts, oxycellulose, polyvinyl maleic acid polymer and its ammonium, sodium, and potassium salts, micro-crystalline cellulose, dextran, dextrin, malto-dextrin, fibrous cellulose, and mixtures thereof; or (3) a mixture of cellulosic, natural, modified natural, or synthetic binders, and (e) from about 5 to about 20 wt. % water, the article having a density within the range of from about 0.05 to about 1.5 g/cc.

As used herein, tobacco particles may be any type of particularized tobacco and will generally be comminuted tobacco selected from the group consisting of bright, burley, oriental, and mixtures thereof, comminuted reconstituted tobacco, comminuted stems, tobacco dust or fines, and mixtures thereof. The tobacco may have been previously subjected to a stiffening or expansion process to increase its filling power. The tobacco or a portion thereof also may have been previously subjected to a heat treatment to bring about a weight loss greater than about 10%, and preferably less than 80%. Such a heat treatment thermally degrades the tobacco and results in charred tobacco particles.

When tobacco particle sizes greater than 35 mesh are employed, it may be necessary to add a polyfunctional acid, such as citric or phosphoric acid and their ammonium, sodium, and potassium salts, during formation of the wet blend in order to achieve the desired appearance and foaming of the extruded article. The polyfunctional acid or its salts is added in an amount such that the smoking article contains from about 0.1 to about 15 wt. % thereof, preferably from about 2 to about 10 wt. %. A typical binder combination is 5 wt. % hydroxypropyl cellulose, 2.5 wt. % carboxymethyl cellulose, and 2.5 wt. % starch. Another typical combination is 1 wt. % hydroxypropyl cellulose, 4 wt. % hydroxypropyl guar and 5 wt. % starch.

The article may also include as a filler any particulate material having a particle size of up to about 350 μm that is compatible with the other components of the blend. The filler is preferably selected from the group consisting of calcium carbonate, magnesium carbonate, calcium oxide, magnesium oxide, calcium hydroxide, magnesium hydroxide, metallic aluminum, alumina, hydrated alumina, clay, diatomaceous earth, silica, titanium dioxide, zinc oxide, iron oxides, carbon, carbonized materials (e.g., carbonized tobacco plant parts) and mixtures thereof and preferably is calcium carbonate.

The dried or equilibrated smoking article contains from about 5 to about 20 wt. % OV, preferably from about 8 to about 16 wt. %.

The smoking article comprises a porous structure that permits static burning and the passage of smoke (gas/aerosol) through the article to the smoker. The density of the article is related to the porous structure and the open cellular structure created in a single strand extruded product, or the voids created between the strands in a multistranded extruded product, and an article having a density within the specified range and having either type of air passageway provides good burn rate and transmission of smoke to the smoker.

The smoking articles may also include from about 0.001 to about 1 wt. % of an alcohol in which the cellulosic binder is soluble. That alcohol is selected from the group consisting of ethanol, methanol, isopropanol, n-propanol, and mixtures thereof. The alcohol present in the smoking article may result from adding alcohol during the formation of the article to lower the moisture content of the extrudate at the die or may be residual alcohol as a result of adding flavor casings.

The smoking article may also contain from about 0.1 to about 40 wt. %, preferably from about 0.5 to about 20 wt. %, of a cross-linking or stiffening agent. The stiffening agent which is preferably added prior to extrusion and then cross-linked during extrusion is selected from the group consisting of alginic acid, carboxymethyl chitin, pectinic acid, chitosan, carboxymethyl chitosan, water soluble salts thereof, malto-dextrins and mixtures thereof. From about 0.1 to about 10.0 wt. % of a water soluble salt of calcium, magnesium, and/or aluminum may also be used.

The smoking articles are preferably extruded and formed as generally cylindrical, coherent, single or multistrand articles having a diameter of from about 2 to about 35 mm, preferably from about 4 to about 25 mm. Alternate cross-sectional configurations may be made with an appropriate die, for example, oval, star-shaped, cylindrical, and the like, or shaped appropriately in an additional post-extrusion process. A post extrusion sizing die also may be used.

In accordance with the present invention, flavorants or other additives are added to an extruded material by passing extrudate 20 through box 30 containing a dry powdery material, preferably tobacco of a single type or a blend of tobaccos having an OV less than 15% or some other spice or flavorant, and optionally, spreading the flavorant over the surface of the extrudate by passing the coated extrudate through wiper means 31.

These rods are typically cut into conventional cigarette or cigar lengths and may be wrapped with cigarette paper, a cigar wrapper, or a coextruded shell of combustible material or the like. The articles may be thus marketed as non-filtered "cigarettes" or as "cigars." A conventional filter may be joined to the "cigarette" by tipping paper to form a filtered smoking article.

These tobacco-containing articles are preferably made by mixing or blending together the tobacco particles with binder, filler, foaming agent, cross-linking or stiffening agent, and any other desired ingredient with water or similar solvent to form a wet blend, and extruding the wet blend through a selected die in accordance with one of the following extrusion conditions such that (1) as the wet blend is extruded in the form of a single strand the moisture or other foaming agent in the blend is converted to steam or other gaseous product so as to foam the extruded material as it exits the die of the extruder; or (2) the wet blend is extruded to form a plurality of strands which are processed in a drying chamber under conditions that cause the moisture or other foaming agent in the extruded material to be converted to steam or other gaseous product, thereby foaming the material. When multistranded extrudates are formed, each strand must be foamed and randomly or uniformly adhered to neighboring strands along their length, either by the foaming action or by the application of an adhesive in post extrusion processing.

Mixing may be carried out in any conventional mixing device and the resulting mixture is to e a wet blend containing from about 15 to about 50 wt. % of water.

As indicated in the FIGURE, the extruded material may be formed by (a) dry blending tobacco particles with binder, filler, foaming agent, cross-linking or stiffening agent, and any other desired ingredient; (b) admixing this dry blend with water to form a wet blend; and (c) extruding the wet blend through a die having one or a plurality of holes in accordance with one of the extrusion conditions set forth above so as to foam the extruded material as it exits the die.

Alternately, the extruded material may be formed by (1) dry blending tobacco particles with filler, foaming agent, cross-linking or stiffening agent, and any other desired ingredient, (2) prehydrating the binder material with water or similar solvent to activate the adhesive character of the binder, (3) admixing the dry blend and the prehydrated binder to form a wet blend, and (4) extruding the wet blend through a die under any of the extrusion conditions set forth above, preferably so as to substantially foam the extruded material as it exits the die.

This procedure is used in conjunction with a twin screw positive mass displacement extruder having multiple feed ports (not shown). Step (2) prehydration is performed by adding the binder materials to a first feed port of the extruder and by adding the water or similar solvent to a second feed port a distance downstream of the first feed port so that as a charge of binder is inserted, it is processed, sheared, and homogenized as it progresses down the extrusion barrels. Then it is admixed with the water as it passes the second port, prehydrating the binder as the materials are displaced down the extruder barrel. Step (1), dry blending the tobacco, filler, and other materials occurs in a conventional mixing device and is added in a blended state to the extruder barrel by a third feed port, a distance downstream of the second port. Thus the prehydrated binder material from step (2) is admixed with the tobacco and other materials from step (1) in a continuous feed process. Because some extruder and mixing apparatus cannot generate the forces necessary to process and extrude the smoking article in accordance with the preferred procedure, it may be advantageous to dry blend with the binder a small amount of tobacco particles, preferably an amount less than 5 wt. % of the tobacco, a small amount of filler, or other added component, and then prehydrate the blended binder and tobacco or other components. The resultant wet blend will have a lower viscosity than if no tobacco or other component were present and may be more easily processed without significantly raising the moisture content of the mass.

Also, because the viscous prehydrated binder can become very sticky and adhere to the mixing equipment, it is advantageous to dry blend with the binder a small amount of tobacco particles, filler material, or both. The amount of tobacco added is preferably less than about 5 wt. % of the tobacco added. The dry blend is then prehydrated, resulting in a wet blend that has a reduced tendency to stick to the processing equipment and is relatively easier to process uniformly, as the material progresses from one step to the next.

Alternately, a portion of the binder may be dry blended with the tobacco and the balance of the binder prehydrated. Because of the relative surplus of water or similar solvent (later taken up by the dry blended tobacco and binder), the viscosity will be lower and the mass easier to handle. Although having a somewhat higher OV content than without cross mixing tobacco and binder in steps (1) and (2), the more efficient activation of the binder results in a dryer and stronger extrudate than that made without prehydrating the binder.

Optionally, a foaming agent may be added to the mixture, preferably selected from the group consisting of air, nitrogen, carbon dioxide, nitrous oxide, ammonium carbonate, ammonium carbamate, ammonium and/or sodium or potassium bicarbonate, an azide, a hydrazide, pentane, hexane, heptane, a halogenated fluorocarbon, pyrrole, acetone, ethanol, a peroxide, and azodicarbonamide. Some of these foaming agents may require the addition of an acid or a base for decomposition, and the use of a foam stabilizer and/or a suitable surfactant such as licorice, yucca or yucca extracts, sodium lauryl sulfate, protein hydrolzate etc.

Extruder 1 may be any conventional extruder having input apertures for materials, mixing chamber or barrel 13 for thoroughly mixing the tobacco slurry ingredients and a die output. Typical extruders include, for example, Wenger Model X-20 single screw cooker/extruder, a Manley collet-type extruder, or twin screw extruders such as those made by Werner and Pfleiderer, C. L. Simon, and Baker Perkins (Models MPF-50D and MPF-50L).

The ingredients of the selected tobacco containing slurry are mixed together in accordance with any procedure and extruded as a cohesive mass, preferably as a foamed product. The extruded material, foamed or not, is moist and pliable, typically having an OV content in the range of 17–28%, depending on the processing conditions used. Particular methods, alternate formulations, and additional details regarding foamed, extruded materials are discussed in U.S. Patent applications Ser. Nos. 723,883 and 740,325.

The preferred foamed extruded material foams as it exits the die, giving off large quantities of steam, which may have a slight cooling effect on the extruded material, but the bulk temperature will be typically at about, and probably just below, the flash point of the solvent used. These hot, moist materials exhibit little or no rigidity and have tacky surfaces. They deform easily and cannot be wrapped or manipulated into smoking articles having a substantially uniform density or consistancy.

In accordance with the present invention, these extruded materials are immediately passed through drying chamber 2 to lower the moisture content to at about or below the equilibrium moisture content level. Microwave drying is preferred because: (1) it dries the material fast and uniformly; (2) it can cause any foaming agent or residual foaming agent present to volatize to foam, or additionally or more completely foam the product; (3) it rapidly dries the material without adversely affecting the foamed structure once all the foaming is complete; (4) it can be used to dry materials extruded at high rates of speed, for example, 50–250 meters per minute, in a short period of time using equipment occupying little floor space, e.g., 3 meters; (5) it is more energy efficient than prior art drying ovens because the energy required to dry the material is applied directly to the material at the necessary energy density and is not wasted in having to also heat long chambers or large volumes of air; and (6) no case hardening occurs as with conventional convection drying ovens.

In the preferred embodiment, where the extruded material is in the range from about 10–20 mm upon exiting the die (8 mm in final diameter), two substantially identical microwave energy sources and cavities are used, for example Model 56F, manufactured by Cober. These models each have a power capacity of about 6 kw and operated at about 2450 MHz. The microwave cavity dimensions also are the same being about 127 mm×82.55 mm×146.05 mm, having the input and output apertures of both cavities in axial alignment and a distance of about 864 mm separates the output and input walls of the two adjacent cavities. Equivalent models or a single microwave unit having the equivalent total power capacity may be used in the alternative. For other configurations of extruded materials, e.g., sheets, greater power may be required to dry adequately the extruded material, as may be determined empirically.

Other known frequencies capable of exciting the resonant frequency of the molecules of the moisture or other solvent or foaming agent in the extruded material for volatizing those molecules could be used. Vent means 25 is provided to exhaust the moisture, solvent, or other foaming agent volatized during drying, and foaming, if any, to thereby facilitate drying. Endless conveyor 17, comprising a nonconductive material that does not appreciably interfere with the passage of microwave energy therethrough, e.g., polyester, nylon, etc., may be used to support the extruded material as it passes through the drying cavity.

Cooling chamber 3 may comprise air conditioner 15, air fan 16 and conveyor belt 6. Air conditioner 15 may be any conventional air conditioner capable of providing refrigerated air such as, for example, a Comfort Aire, ton unit, manufactured by Heat Controller Inc., Jackson, Mich. Air fan 16 is designed to distribute the refrigerated air at a selected flow rate along and preferably perpendicular to the path extruded material 20 follows as it advances across endless conveyor belt 6. Conveyor belt 6 is preferably perforated. The distribution of refrigerated air may be relatively uniform or it may be graduated so that there is more or cooler air at one location along cooling chamber 3 than another. In an alternate embodiment, the direction of cool air flow may be incident or parallel to the extruded material. Air fan 16 and air conditioner 15 may be incorporated into a single unit.

In an alternate embodiment, cooling chamber 3 may be air impinging jets such as the Air Miser manufactured by Huestis Machine Corporation, Bristol, R.I. Such a device could be used to impinge air or refrigerated air at high velocity on the surface of the extruded material, through a plurality of air jets, to cool the air and dry and cool the extruded material. Other cooling means could be used such as cryogenic baths, cold contacting members and other techniques for removing heat from the extruded material.

In one embodiment, the drying and cooling are coordinated so that the resulting product has an OV content below the equilibrium OV content. This permits wrapping the extruded material with a conventional wrapper while it is in a more dry condition so that when the extruded material equilibrates, the extruded material will absorb some moisture and expand slightly and tighten against the wrapper. This will substantially prevent the wrapper from falling off the smoking article, e.g., in low humidity environments, and give the product the look and feel of a conventional cut tobacco-filler smoking article.

In yet another embodiment, the dried extrudate also may be passed through a heated die in the presence of a reduced oxygen atmosphere to char or carbonize the extrudate and effect a weight loss of at least 30%, preferably in a range between 50 and 80%. See, e.g., U.S. Pat. No. 4,481,958 for a discussion of carbonizing rod-like material.

The rapid drying and cooling steps are particularly adaptable to preserving tobacco flavors and characteristics originally present in the tobacco that might otherwise be lost due to volatilization during extrusion and heating, by cooling the extruded material rapidly and thereby reducing the temperature below the volatilization temperature of the flavors.

Foamed products create a thermal barrier that somewhat inhibits cooling the interior of the extruded material. By cooling the exterior rapidly, a thermal gradient is created across the cross section. Thus, by maintaining the exterior relatively cooler than the interior, the natural flavors of the original tobacco and any additives or flavors in or added to at least the substantially cooler periphery of the extruded material may be preserved. The loss of flavors from the relatively interior extruded material is therefore less significant and can be compensated for accordingly.

The present invention is particularly adaptable to add to an extruded rod flavors or other additives that may not or do not survive any or all of an extrusion, foaming, or drying (and, where applicable, charring) conditions and temperature and further, to add materials to the surface to facilitate processing of the rod into smoking articles. In this regard, apparatus including box 30 for coating an advancing extruded rod with powdery materials could be located so as to add flavors or other additives to the extruded material preferably after a drying or a cooling step, or both, without significant loss of flavor or other modified characteristics due to volatization of the added materials. In the preferred embodiment, these flavorant materials are applied by passing an extrudate through a box adapted for vibrating at a rate and amplitude sufficient to prevent the dry powdery material from being packed or bridged so as to not contact the advancing extrudate. In a preferred embodiment, the extrudate has been dried and cooled but retains a sticky exterior surface so that powdery materials will readily adhere to the surface.

Maker device 4 may be any commercially available cigarette manufacturing device, such as a Mark 8 or a Mark 9 Cigarette Maker manufactured by the Molins Company, or an equivalent Hauni Company model, modified appropriately by, for example, removing the hopper. Other smoking article forming devices (not shown) could include apparatus such as grinders, slitters, shredders or the like used for processing the dried and cooled extruded material, preparatory for use in forming typical smoking products, e.g., pipe, smokeless, cigarette or cigar tobacco. In the preferred embodiment, the extruded material is fed directly into the garniture of a Mark 8 Cigarette Maker which was modified by removing the chimney section and replacing it with funnel 14 disposed for receiving the extruded material in either a single or multi-stranded rod-like form, before or after the rod like material is wrapped conventionally, if at all, and fed into the garniture. After the garniture, the rod is severed by the cut off knife into substantially uniform lengths appropriate for formation into smoking articles and removed by the revolving take off wheel for subsequent handling in accordance with conventional cigarette-type smoking article forming methods and apparatus.

Puller apparatus 5 may be a pinch roll feed type puller or a pair of opposing endless advancing belts designed and operated for use in start up conditions for feeding the leading edge of the extruded material into funnel 14. Puller 5 operates to maintain slight tension on the extruded material across cooling chamber 3 during start up. Once the extruded rod has been fed into funnel 14, and into the garniture so that the garniture pulls on the rod, puller 5 is typically disengaged and the opposing belts separated to prevent damaging the extruded material by exerting forces on the material as the material advances. Commercially available pullers are available from Versa Machinery Division, Foster & Allen Inc., Somerville, N.J., e.g., Model CM22.

The driven apparatus, conveyor belt 17, conveyor belt 6, puller 5, maker device 4, and extruder 1 may all be synchronized by a tachometer (not shown) or equivalent timing means to the drying capacity of microwave cavity 2. The drying capacity can be adjusted for the desired process conditions and the desired extruded material moisture characteristics, primarily by changing the power level of microwave energy propagated into the microwave cavities. Additional cooling means may be required at higher rates of speed when large amounts of microwave energy are used to dry the material. Thus, for the given rate of advance of the extruded material, and the related residence time of the extruded material in the microwave heating cavity, the desired OV level can be achieved. For example, drying extruded material having about an 8.0±0.1 mm diameter and advancing at about 182 meters per minute from 20% OV to less than 6% OV can be achieved using a total of about 10 kw of power distributed between the two microwave cavities. Using 9 kw of power resulted in an OV content of about 8%.

The method of this invention further contemplates performing the foregoing operations using the described apparatus at high rates of speed so that the tobacco slurry ingredients can be continuously mixed, extruded, dried, cooled, and formed into smoking articles continuously in a single work station area on the factory floor. The foamed extruded material of the preferred embodiment can be produced at rates from zero to in excess of about 250 meters per minutes in a rod of about 8 mm in diameter. These rates are well within the capacity of conventional cigarette maker devices.

To illustrate further the present invention, the following representative examples are presented.

EXAMPLE I

The conventional formulation of minute, finely divided tobacco particles, binder materials, and water were fed to their respective input ports of a Baker Perkins Model MPF-50L twin screw extruder. The tobacco was fed at a rate of about 0.82 kg/min of tobacco dust. The binder mixture was 1% klucel, 4% hydroxypropyl guar, and 5% starch, premixed to form a blend that was fed at a rate of 0.09 kg/min. The tobacco and binder were mixed together and added to a common port of the extruder mixing barrel. Water was added downstream at a rate sufficient to maintain about 20–23% OV in the mixing barrel of the extruder. The OV content of the extruded material as it exited the die was measured to be about 17.2%. The bulk temperature was about 130° C. and the surface temperature was about 95° C. The extruded material was passed through twin microwave cavities at a speed of about 124 meters per minute. The drying cavity included a first and second microwave cavity with the first cavity and second cavities set at a combined power level of 7 kw. The OV content of the extruded material as it exited the drying cavity was at about 10.9%. The surface temperature of the extruded material was 61.7° C. and the bulk temperature was 91.7° C. The dried extruded material possessed little or no rigidity.

The extruded material was then passed through a cooling section that was about 4.6 meters long. Refrigerated air chilled to 15.5° C. was generated and blown perpendicular to the extruded material at a velocity of 104 meters per minute. The extruded material was cooled to a surface temperature of about 46.7° C. and a bulk temperature of 85° C. The OV content dropped to 9.9%. At this point, the extruded material possessed sufficient rigidity to be cut and wrapped using the modified Mark 8 maker. The bulk temperature of the resulting wrapped cigarette rods of dried and cooled extruded material was about 57° C.

In the course of experimentation, it was discovered that the total microwave energy absorbed by the extruded material was more important than whether the two microwave cavities produced the same energy level, or which unit provided more power. For example, substantially the same results were found when the first unit produced 3 kw and the second unit produced 4 kw, as when the first unit produced 4 kw and the second unit produced 3 kw. Similar results were found with the power divided into 2 kw in one unit and 5 kw in the other unit. It was also discovered that for every additional kilowatt of microwave energy absorbed, the OV content would be lowered by about 1.2%. Lowering the power similarly resulted in a higher OV content. Typical extrusion rates for the preferred tobacco-containing materials include from 270 to 455 meter/min, but faster or slower rates are possible within the limits of the equipment. These materials can be dried to desired moisture levels of between about 8% and 14% by using from about 5 kw to 10 kw, distributed between the two microwave cavities. Cooling the extruded materials using refrigerated air cooled to temperatures in the range of from about 1° C. to 16° C. and blown across the material at velocities of from about 50 to 150 meter/min was sufficient to cool the dried extruded material for wrapping and forming.

Example II

The same materials and conditions of Example I were repeated with the addition of a powder coating box located immediately downstream from the microwave cavity just prior to the cooling chamber. The hot, moist and sticky extrudate was passed through a vibrating box containing the desired powder. The coated extrudate was then passed through a funnel type wiper or sizing die to smear and embed the coating evenly on and in the extrudate surface and to remove any excess powder from the coated surface. Thereafter the extrudate was cooled and wrapped as described in Example I. The powdery material used in separate runs included an individual tobacco powder, a blended tobacco powder, and $CaCO_3$.

Example III

The same materials and conditions of Example II were repeated except that the powder coating box and wiper were located immediately downstream from the cooling chamber.

In both Examples II and III the resultant smoking articles were found to have acceptable and improved subjective qualities as compared to the uncoated smoking articles. Experimental results indicate that a combination of different dry powdery materials could be simultaneously used to enhance the flavor and reduce porosity and modify the characteristics of the extruded tobacco containing material.

As various modifications can be made to the method and apparatus of this invention and the material to which this invention pertain, it is intended that all matter contained in the above description or shown in the FIGURE shall be interpreted as illustrative and not in a limiting sense.

We claim:

1. A method for processing continuously extruded tobacco-containing materials comprising providing an extruded tobacco-containing material having an OV content less than about 28%, and applying a powdery material to the surface of said extruded material, said powdery material modifying the characteristics of the resultant smoking article and said powdery material being selected from among the group consisting of tobacco, spices of other flavorants, inorganic or organometallic salts, fillers, or hydrocolloids.

2. A method for processing continuously extruded tobacco-containing material, comprising:

providing an extruded tobacco-containing material having an OV content less than about 28%;

applying a powdery material to the surface of said extruded material, said powdery material modifying the characteristics of the resultant smoking article and said powdery material being selected from among the group consisting of tobacco, spices or other flavorants, inorganic or organometallic salts, fillers, or hydrocolloids; and wiping the coated extrudate for spreading the powdery material on the extrudate surface and embedding the powdery material in the extrudate surface.

3. The method of claim 2 wherein said powdery material is film-forming material and the method further comprises the step of heating the applied powdery material so that it forms a film on the extrudate surface.

4. A method for processing continuously extruded tobacco-containing material, comprising:

providing an extruded tobacco-containing material having an OV content less than about 28%;

passing the extrudate through a box containing a powdery material; and agitating the powdery material sufficiently to coat the extrudate completely, thereby applying a powdery material to the surface of the extruded material, said powdery material modifying the characteristics of the resultant smoking article and said dry powdery material being selected from among the group consisting of tobacco, spices or other flavorants, inorganic or organometallic salts, fillers, or hydrocolloids.

5. The method of claim 4 further comprising the step of cooling the extruded material prior to applying powdery material so that the surface temperature of the extrudate is below the volatization temperature of the powdery material.

6. The method of claim 4 further comprising the step of drying the extruded material prior to applying the powdery material.

7. The method of claim 6 wherein drying the extruded material provides the extrudate with a sticky surface.

8. An extruded smoking article produced in accordance with claim 4.

9. A method of processing an extruded, coherent, tobacco-containing, generally cylindrical smoking article having a density within the range of from about 0.05 to about 1.5 g/cc and a structure providing sufficient heat transfer are or sufficient residence time or both for the hot gases drawn towards the proximal end of the smoking article by a smoker to cool and to exit the proximal end at a comfortable temperature for the smoker, the method comprising the steps of:

(a) mixing together from about 5 to about 98 wt. % of tobacco particles having a particle size of up to about 5 mesh and an OV value of from about 3 to about 20%, from 0 to about 60 wt. % of a filler having a particle size of up to about 350 μm, from 0 to about 50 wt. % of a foaming agent including any solvent or vehicle other than water, from about 2 to about 40 wt. % of a binder selected from the group consisting of cellulosic binders, natural binders, modified natural binders, synthetic binders, and mixtures thereof, and water to form a wet blend containing from about 15 to about 50 wt. % of water;

(b) extruding the wet blend from step (a) through a die to form an extruded material; and (c) applying a powdery material to the surface of the extruded material, said powdery material modifying the characteristics of the resultant smoking article and said dry powdery material being selected from among the group consisting of tobacco, spices or other flavorants, inorganic or organometallic salts, fillers, or hydrocolloids.

10. The method of claim 9 further comprising wiping the coated extrudate to spread the powdery material on the extrudate surface and embed the powdery material in the extrudate surface.

11. The method of claim 10 wherein said powdery material is a film-forming material and the method further comprises the step of heating said applied powdery material so that it forms a film on the extrudate surface.

12. The method of claim 9 wherein applying the powdery material further comprises passing the extrudate through a box containing the powdery material, and agitating the powdery material sufficiently to coat the extrudate completely.

13. The method of claim 12 further comprising the step of cooling the extruded material prior to applying powdery material so that the surface temperature of the extrudate is below the volatization temperature of the powdery material.

14. The method of claim 12 further comprising the step of drying the extruded material prior to applying the powdery material.

15. The method of claim 14 wherein drying the extruded material provides the extrudate with a sticky surface.

16. An extruded smoking article produced in accordance with claim 12.

17. Apparatus for processing continuously advancing extruded tobacco containing material comprising:

means for providing an extruded tobacco-containing material having an OV content less than about 28%;

a box for containing a powdery material, said powdery material adapted for modifying the characteristics of the extruded tobacco-containing material, said box having a passageway for passing the extruded material therethrough; and means for agitating said powdery material in the box while the extruded material is passing through the box so that said powdery material surrounds and coats the surface of the extruded material with said powdery material.

18. The apparatus of claim 17 further comprising means for wiping the surface of the coated extruded material to remove excess powdery material and distribute the powdery material on he surface of the extruded material.

19. The apparatus of claim 17 where in the powdery material is a film-forming material, said apparatus further comprises means for heating said applied powdery material so that it forms a film on the surface of the extruded material.

* * * * *